United States Patent [19]

Pastorel

[11] 4,031,340

[45] June 21, 1977

[54] DEFEATER FOR MECHANICAL SAFETY INTERLOCK FOR COVERS OF EXPLOSION-PROOF ELECTRICAL HOUSING

[75] Inventor: Robert J. Pastorel, Chicago, Ill.

[73] Assignee: Appleton Electric Company, Chicago, Ill.

[22] Filed: Nov. 7, 1975

[21] Appl. No.: 629,900

[52] U.S. Cl. ..... 200/50 A; 74/483 R; 174/52 R; 200/302

[51] Int. Cl.[2] ..... H01H 9/20; H01H 33/46

[58] Field of Search ..... 174/52 R; 200/50 A, 200/50 B; 74/483; 220/288

[56] References Cited

UNITED STATES PATENTS

| | | | |
|---|---|---|---|
| 1,971,990 | 8/1934 | Reynolds et al. | 200/50 B |
| 2,156,572 | 5/1939 | Olley | 200/50 A |
| 2,194,549 | 3/1940 | Hardage | 200/50 A |
| 2,284,613 | 5/1942 | Hyde, Jr. | 200/50 A |
| 3,016,431 | 1/1962 | Steigerwald | 200/50 A |
| 3,743,800 | 7/1973 | Appleton et al. | 200/50 A |

*Primary Examiner*—James R. Scott
*Attorney, Agent, or Firm*—Darbo, Robertson & Vandenburgh

[57] ABSTRACT

An explosion-proof electrical enclosure has a body, switch mounted within the body, two threaded caps cooperatively engaging manually defeatable locking bolts in the body which prevent rotation of the caps and manually operated interlocking mechanism mounted in the body to actuate a switch and prevent unlocking of the bolts in the switch on position.

4 Claims, 4 Drawing Figures

DEFEATER FOR MECHANICAL SAFETY INTERLOCK FOR COVERS OF EXPLOSION-PROOF ELECTRICAL HOUSING

BACKGROUND AND SUMMARY OF THE INVENTION

Where electrical circuit breaking devices, such as switches, etc., are located in an area in which explosive atmospheres may be present, provision must be made to prevent those circuit breaking devices from igniting the atmosphere and thereby causing an explosion. The conventional procedure is to enclose such devices in a case which will prevent any ignition which occurs within the case from propagating to the space outside the case. Such cases must, of course, have access openings so that the installer or a repairman can get at the electrical devices within the case. Such access openings are provided with covers. A common practice is to utilize an interlock between the electrical device within the case and the cover which will prevent the cover from being removed should the device be in switch-closed position. Otherwise, it would be possible for a careless person to remove the cover and thereafter move the device to switch-open position, with the result being that the flame occurring within the case could easily propagate to the outside through the access opening from which the cover had been removed. An example of such a device will be found in U.S. Pat. No. 3,743,800.

It has been found that there are occasions where it is important that a serviceman, etc., be able to remove the cover while the electrical device within the housing is in switch-closed position. For example, one or more large machines may be electrically connected to the box. It could, for example, be a machine involved in a continuous chemical process which, if interrupted, would result in a prolonged restarting operation and loss of product in process. Shutting such machines down even briefly might be an expensive procedure. Yet, for some good reason the serviceman must have access to the interior of the housing. Also, the serviceman may have gas detectors available by which he can determine that an explosive atmosphere does not exist about the housing; and, therefore, a temporary removal of the cover to provide access to the interior of the housing could be made without fear of causing an explosion. Even if he knew an explosive atmosphere existed, the experienced serviceman might know that, with his knowledge and experience, work could safely be performed inside the box without the necessity of interrupting the electrical circuit.

One solution to this problem might be to remove the safety interlock altogether. However, this would permit careless individuals, or individuals who did not have sufficient knowledge of the situation to be careful about what they did, to remove the covers. Thus the possibility of an explosion would remain. The solution provided by the present invention is to provide a defeater operable from the exterior of the housing to render the safety interlock ineffective so that the covers can be removed. The exterior, operable part of this defeater is inconspicuous. One not sufficiently knowledgeable to know about the interlock, why it was there, etc., would not recognize the defeater for what is was and therefore would not use it to obtain access to the interior of the housing. Instead, he would follow the conventional practice of turning the switch handle to the "off" position to permit him to remove the cover.

Further objects and advantages will become apparent from the following description.

DESCRIPTION OF SPECIFIC EMBODIMENT

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

Figure 1:
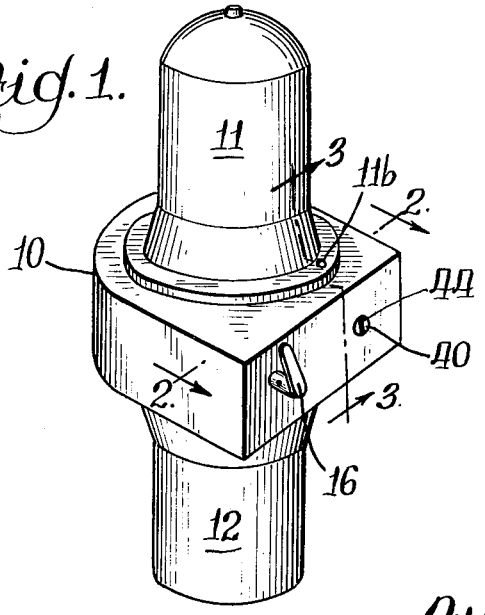
FIG. 1 is a perspective view of an explosion-proof electrical housing embodying the present invention.
Figure 3:
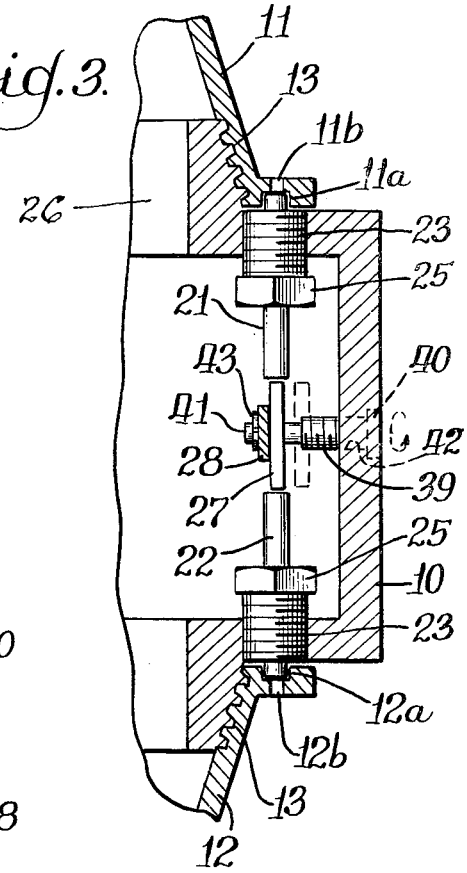
FIG. 3 is a partial section as viewed at line 3—3 of FIG. 1.
Figure 2:
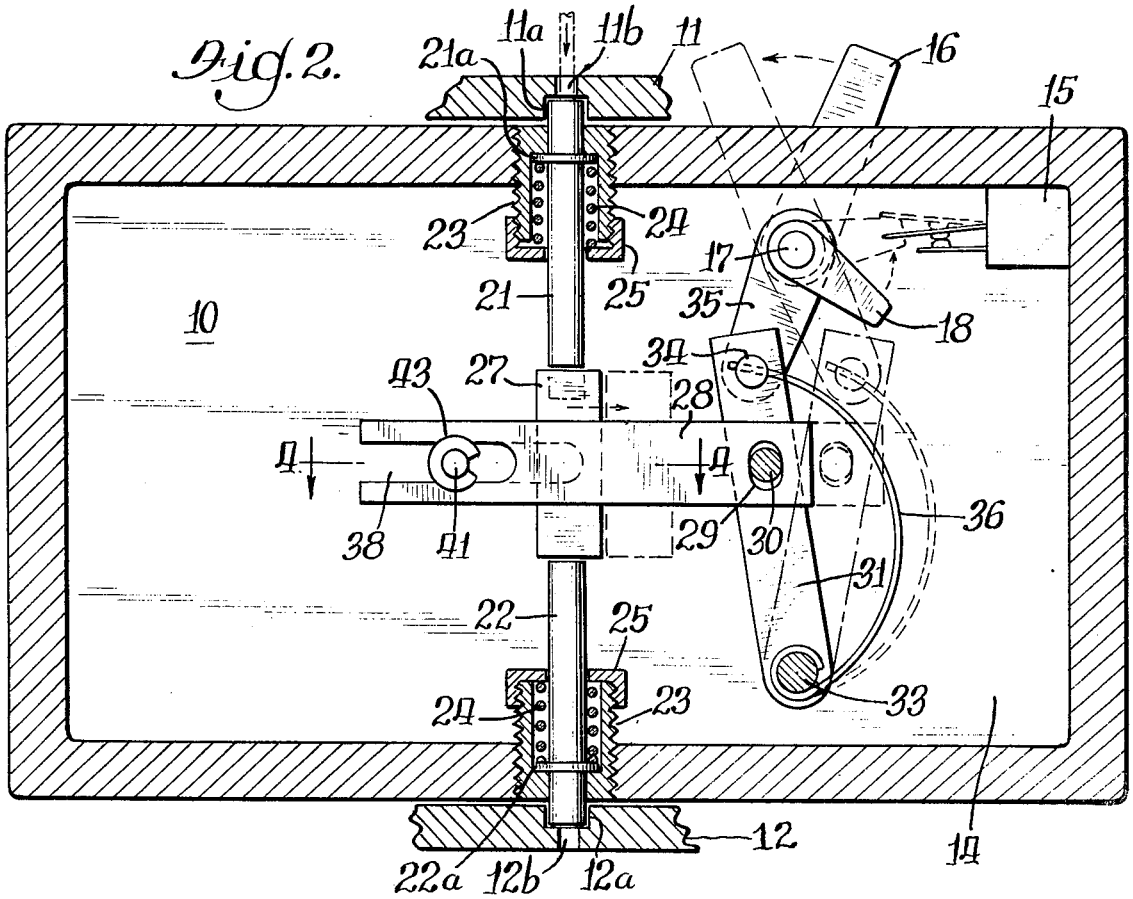
FIG. 2 is a section as taken at line 2—2 of FIG. 1.

The drawings illustrate an explosion-proof electrical housing which includes a body 10 and a pair of covers or caps 11 and 12 used to close access openings in the body. As seen in FIG. 3, the caps have threads 13 which engage corresponding threads on the body to hold the caps in place. Within the interior space 14 defined by this enclosure there is circuit breaking electrical apparatus, which is schematic depicted by the representation 15 of an electrical switch. A handle 16 on the exterior of the enclosure is secured to a shaft 17 and is used to rotate the shaft between a first position at which the switch is in circuit-open position and a second, circuit-closed position. For the purposes of illustration, an arm 18 is secured to shaft 17. When the handle 16 is in the position illustrated in full line in FIG. 2 the contacts of swtich 15 are closed. When the handle is moved to the dashed line position the arm 18 moves counterclockwise to contact the leaf of the switch and move it to switch-open position, illustrated in dashed lines.

A pair of locking bolts 21 and 22 are slideably mounted in inserts 23 threaded into and forming a part of body 10. These bolts are urged outwardly by springs 24 which are in compression between caps 25 and abutments 21*a*, 22*a* forming a part of the bolts 21, 22. The abutments also serve as stops to limit the outward movement of the bolts by contact with inserts 23. The exterior ends of the bolts extend into recesses 11*a*, 12*a* in the caps 11, 12, respectively. When thus seated in the recesses, the bolts prevent the rotation of the caps and thus the unthreading of the threads 13. The caps are thereby locked in place. Aligned with each of the recesses 11*a*, 12*a* are small openings 11*b*, 12*b*. Absent the interlocking device, hereinafter described, a person can insert a slender implement, e.g., a nail, through opening 11*b*, for example. By pressing inwardly on the bolt 21, the bolt can be moved against the resistance of spring 24 to a position at which it no longer extends into recess 11*a*. Thereupon, cap 11 can be rotated to disengage threads 13 and permit the removal of the cap. Thereupon access opening 26 communicating with the interior space 14 is uncovered to permit a person access to the interior of the enclosure. In a corresponding fashion, cap 12 also can be removed.

The interlock which prevents the locking bolts from being displaced inwardly as described above, when the handle 16 is in the switch-closed position, includes a spacer or locking part 27 which is positioned between the inner ends of the bolts 21. The spacer is moved out from between those locking bolts when the handle 16 is moved to the switch-off position (illustrated in dashed lines in FIG. 2). This spacer is secured to a bar 28. One end of the bar has an oval opening 29 through which a pin 30 extends. This pin is secured to a link 31 and has a head, cotter key, C-ring, or the like, on the other end (not shown) for retaining the bar on the pin. The link is pivotally mounted on a fixed shaft 33 at one end and has its other end connected by a pin 34 to a link 35 secured to shaft 17. A spring 36 is mounted on shaft 33 and extends through pin 34. This spring is used to hold handle 16 in whichever of its two alternate positions it is otherwise set.

The other end of bar 28 is bifurcated to define a slot 38. A pin has a threaded shank 39, an exterior end 40 and a distal, interior end 41. The shank 39 is received in a threaded opening 42 in the body wall. The inner end 41 extends through slot 38 and at each side of the bar 28 it has C-washers 43 seated in annular slots therein. The exterior end or head 40 of the pin is formed to receive a tool, such as a slot to receive a screwdriver or a hexagonal opening to receive an Allen wrench, etc. For the purposes of illustration, a screwdriver slot 44 is illustrated.

Figure 4:
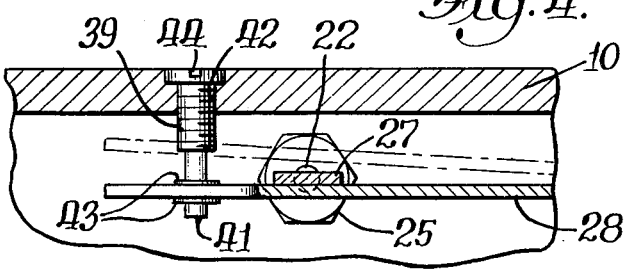
FIG. 4 is a partial section as viewed at line 4—4 of FIG. 2.

By engaging the head 40 with the appropriate tool, the pin can be rotated in a direction such that it moves towards the exterior of the body. As it does so, the C-washers 43 engage the bar 28 and move it a corresponding amount. Thus, the bar 28 may be moved to the dashed line illustrated in FIGS. 3 and 4. In this position of the bar, the spacer 27 no longer is between the inner ends of the pins 21, 22, even though the handle 16 is in the full line position of FIG. 2, indicative of switch-closed position. Thus, the purpose of the interlock has been defeated and a person is free to insert a tool into one or both of openings **11*b*, 12*b* to displace the respective bolt 21, 22 for cover removal, as previously described. After a person replaces the cover, the pin 39–41 is screwed inwardly to return it to the position illustrated in FIGS. 3 and 4. Thereupon the spacer 27 is returned to its location between the pins 21, 22.** The operativeness of the interlock is thereby reestablished.

The exterior operational component of the defeater is not manifest. An unknowledgeable person would not recognize the existence of the head 40 of the pin as having any significance so far as the interlock mechanism was concerned. As a matter of fact, he might even not know that the interlock existed. If he tried to remove one of the caps 11, 12 he would find that he could not do so so long as handle 16 is in the switch-closed position. However, a knowledgeable person would understand that the interlock could be rendered ineffective by the repositioning of pin 39–41, as described above. Presumably such a knowledgeable person also would take precautions to see that no harm would result from the removal of a cap with the switch being in the switch-closed position.

I claim:

1. In an explosion-proof electrical enclosure apparatus comprising a housing having a body with an access opening and threads therearound and a cap threaded onto said threads and covering said opening, an electrical switch within said housing and operable between a switch-open position and a switch-closed position, said switch having a member within said housing for moving the switch between said positions which member is operable from outside said housing, a locking device interengaging said cap and said body and movable between a first position at which said cap is locked at a desired location against rotation and a second position at which said cap is free to be rotated to unthread the cap for removal to expose said opening, and interlocking means operatively interconnecting the switch operating member and said cap locking device and including a locking part movable along a path between two positions respectively corresponding to said two positions of said member for retaining said locking device in said first position thereof so long as the member is in the switch-closed position while freeing the locking device for movement to the second position so long as the member is in the switch-open position, the improvement comprising:

defeater means operatively engaging said interlocking means for moving said locking part along a second path between its position at the switch-closed position and a third position thereof at which it frees the locking device for movement to the second position, said defeater means includes an operating component unmanifestly located at the exterior of said body for moving said locking part along said second path.

2. In an apparatus as set forth in claim 1, wherein said operating component includes a pin extending through said body and threadedly engaging said body whereby when the pin is rotated it moves axially thereof with respect to the body, means on the end of the pin within the body for engaging said interlocking means, the exterior end of the pin having engaging means thereon.

3. In an apparatus as set forth in claim 2 and wherein said locking device includes a bolt mounted in said body, said bolt having an end within said housing and an exterior end for engaging said cap, and spring means engaging said body and bolt for urging said bolt outwardly into engagement with said cap;

said interlocking means includes a bar having a slot therein, said interior end of the pin extending through said slot, means connecting said bar and said member for moving said bar axially and with respect to said pin when said member is moved between said positions thereof, said locking part being mounted on said bar, said pin engaging said bar to move said bar transverse to said bar axis when the pin is moved axially thereof with respect to the body.

4. In an apparatus as set forth in claim 1 and wherein said locking device includes a bolt mounted in said body, said bolt having an end within said housing and an exterior end for engaging said cap, and spring means engaging said body for urging said bolt outwardly into engagement with said cap;

said interlocking means includes a bar, means connecting said bar and said member for moving said bar axially when said member is moved between said positions thereof, said locking part being mounted on said bar;

said operating component includes pin means engaging said bar and movable transverse to the axis of said bolt for moving said bar corresponding to the transverse movement of the pin means.

* * * * *

UNITED STATES PATENT AND TRADEMARK OFFICE

CERTIFICATE OF CORRECTION

PATENT NO. : 4,031,340

DATED : June 21, 1977

INVENTOR(S) : Robert J. Pastorel

It is certified that error appears in the above-identified patent and that said Letters Patent are hereby corrected as shown below:

Column 1, line 66, "is" should read --it--.
Column 4, line 57, --and bolt-- should be inserted after "body".

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*